US007021424B2

(12) United States Patent
Herman

(10) Patent No.: US 7,021,424 B2
(45) Date of Patent: Apr. 4, 2006

(54) SUPPORT PLATFORM

(76) Inventor: Frank W. Herman, 275 Durkee Rd. SE., Cleveland, TN (US) 37323

( * ) Notice: Subject to any disclaimer, the term of this patent is extended or adjusted under 35 U.S.C. 154(b) by 0 days.

(21) Appl. No.: 10/840,466

(22) Filed: May 6, 2004

(65) Prior Publication Data

US 2005/0247833 A1 Nov. 10, 2005

(51) Int. Cl.
*E04G 1/32* (2006.01)

(52) U.S. Cl. ..... 182/224; D25/67; 248/440

(58) Field of Classification Search ..... 182/152, 182/181.1, 182.1, 182.2, 182.3, 182.4, 182.5, 182/224, 186.2, 186.3, 186.4, 226, 225, 155; 144/286.1, 286.5; 248/163.1, 172, 440, 440.1; D25/67

See application file for complete search history.

(56) References Cited

U.S. PATENT DOCUMENTS

| | | | | | |
|---|---|---|---|---|---|
| 1,408,675 | A | * | 3/1922 | Wimberg | 269/296 |
| 1,597,555 | A | * | 8/1926 | Tolmie | 182/224 |
| 1,601,946 | A | * | 10/1926 | Dujardin | 182/224 |
| 1,780,579 | A | * | 11/1930 | Crowley | 182/224 |
| 2,989,142 | A | * | 6/1961 | Gill | 182/224 |
| 3,064,755 | A | * | 11/1962 | Illes | 182/155 |
| 3,082,027 | A | * | 3/1963 | Johnson | 403/169 |
| 3,175,642 | A | * | 3/1965 | Neeley | 182/224 |
| 4,238,001 | A | * | 12/1980 | Alexander | 182/153 |
| 4,296,509 | A | * | 10/1981 | Simmons et al. | 5/85.1 |
| 4,298,093 | A | | 11/1981 | Wing | |
| 4,308,934 | A | | 1/1982 | Jackson et al. | |
| 4,449,842 | A | | 5/1984 | Reichman, Jr. | |
| 4,756,384 | A | * | 7/1988 | Maddox | 182/18 |
| 4,911,390 | A | * | 3/1990 | Flick | 248/168 |
| 5,402,860 | A | * | 4/1995 | Fry | 182/225 |
| 5,484,037 | A | * | 1/1996 | Neumarkel | 182/185.1 |
| 5,954,156 | A | * | 9/1999 | Cooke | 182/153 |
| 6,004,063 | A | | 12/1999 | Adams, Sr. | |
| 6,209,683 | B1 | | 4/2001 | Holtz | |
| 6,758,307 | B1 | * | 7/2004 | Ols | 182/186.3 |
| 6,810,996 | B1 | * | 11/2004 | Rump | 182/186.5 |
| 2003/0213648 | A1 | * | 11/2003 | Dembicks | 182/185.1 |
| 2005/0023083 | A1 | * | 2/2005 | Reimer | 182/186.3 |

* cited by examiner

*Primary Examiner*—Ramon O Ramirez
(74) *Attorney, Agent, or Firm*—Luedeka, Neely & Graham, PC

(57) ABSTRACT

A support platform with a first and second bracket. The brackets each have first, second, and third sleeves. A cross member is inserted into and extends between the first sleeves of the brackets. Leg members are slidably inserted into and extend from the second and third sleeves of the brackets. The leg members inserted in the second sleeves extend substantially away from one side of the cross member at a first angle. The leg members inserted in the third sleeves extend substantially away from the other side of the cross member at a second angle. The second angle is less than the first angle.

19 Claims, 12 Drawing Sheets

SUPPORT PLATFORM

FIELD

This invention relates to the field of support platforms. More particularly, this invention relates to an improved height adjustable support platform.

BACKGROUND

Support platforms, such as saw horses, are often used at construction sites and other job sites for a variety of applications, such as sawing or providing a support for workers to stand on. Saw horses presently in use may work well in applications in flat, open areas. However, job sites typically have uneven terrain. Prior art saw horses are not easily adjustable to account for uneven terrain. Often the length of the legs of saw horses must be permanently adjusted, making the saw horses unusable for future applications with differing terrain.

Further, workers may be required to perform construction operations in close proximity to an assortment of obstacles, such as walls. Prior art saw horses typically have a symmetrical A-frame configuration, with the legs extending outward substantially from a saw horse bracket. Due to the interference caused by the outwardly extending legs, workers using the saw horses as supports can not position the saw horses properly in relation to these obstacles.

A support platform is needed where the individual legs of the support platform may be easily and nonpermanently adjusted to account for uneven terrain. Further, an improved support platform is needed which can be used in close proximity to obstacles.

SUMMARY

The above and other needs are met by a support platform comprising a first and second bracket. The brackets each have first, second, and third sleeves. A cross member is inserted into and extends between the first sleeves of each bracket. Leg members are slidably inserted into and extend from the second and third sleeves of each bracket. The leg members inserted in the second sleeves extend substantially away from one side of the cross member at a first angle. The leg members inserted in the third sleeves extend substantially away from the other side of the cross member at a second angle. The second angle is less than the first angle.

The leg members extend down from the second and third sleeves at an angle less than 45 degrees from the vertical and preferably extend down at a 33 degree angle and 15 degree angle, respectively. Alternatively, the leg members extend down from the third sleeve in a vertical configuration.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1A:
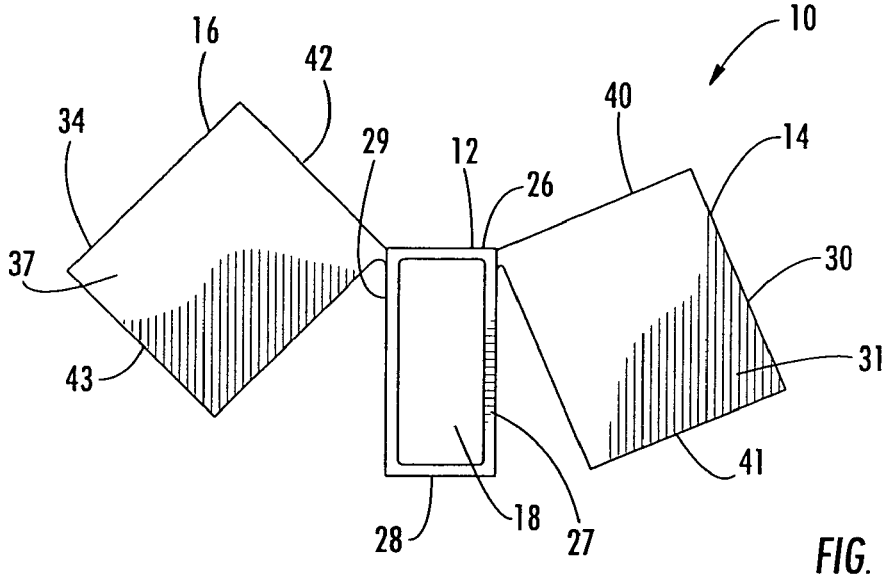
FIGS. 1*a–d* are side views of a support bracket according to a preferred embodiment of the invention.
Figure 1B:
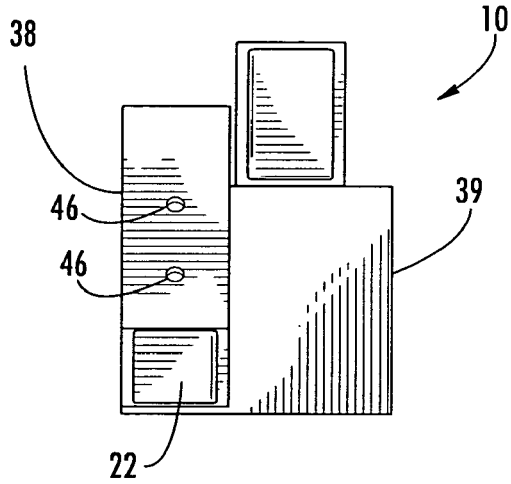
Figure 1C:
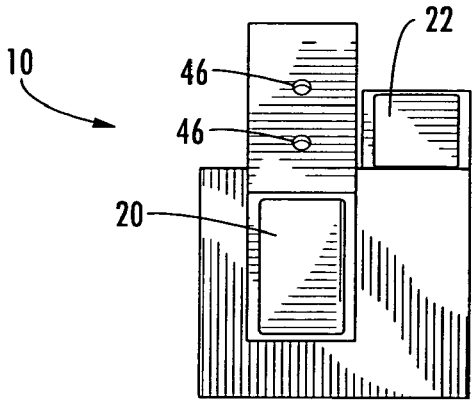
Figure 1D:
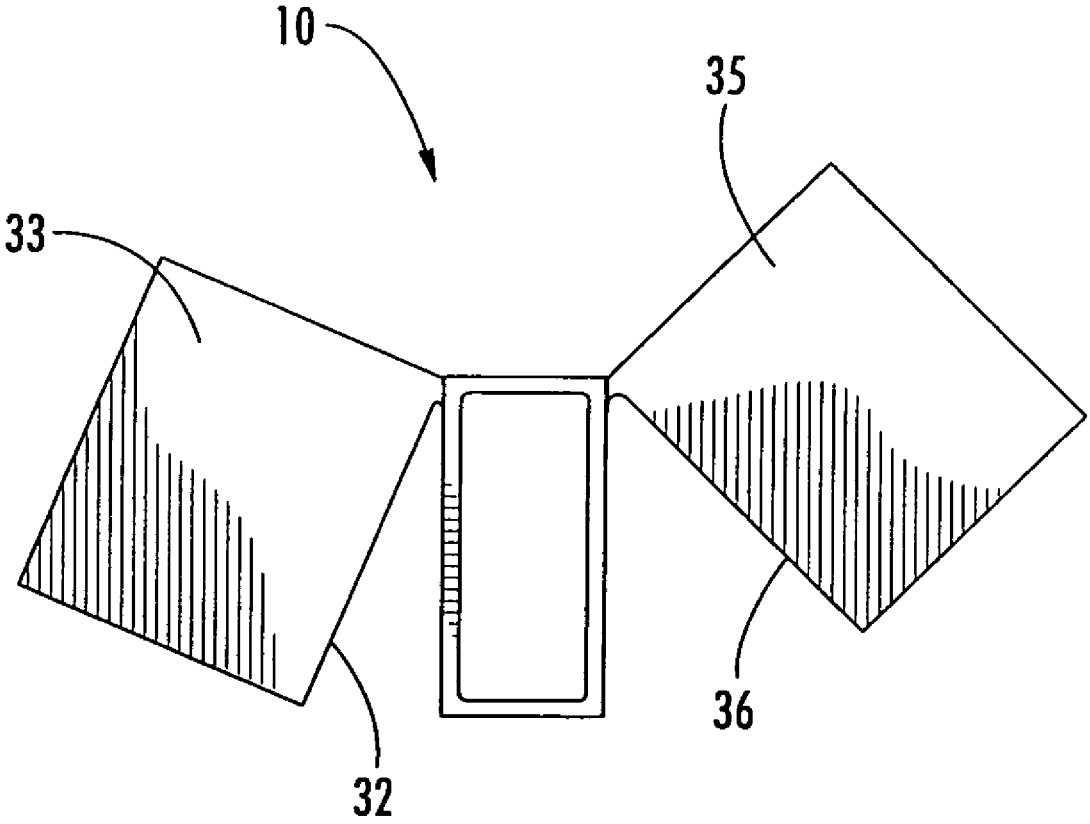

Referring now to FIGS. 1*a–d*, there is shown a bracket 10 for a support platform according to a preferred embodiment of the invention. The bracket is comprised of first, second and third sleeves 12, 14, and 16. Each sleeve 12, 14, and 16 has a substantially rectangular cross sectional opening therein. Preferably, the sleeves are constructed of an extruded plastic material. However, the sleeves may be constructed of any material suitable for a bracket for a support platform, such as steel, aluminum, other metals, other plastics, and the like.

In alternate embodiments, the brackets may comprise retaining assemblies other than sleeves, such as, but not limited to, slotted retainers and clamping retainers.

Sleeve 12 includes first and third opposing sides 26 and 28 and second and fourth opposing sides 27 and 29, respectively. Through-hole 18 in sleeve 12 extends between opposing ends 38 and 39. The through-hole 18 preferably has a substantially rectangular cross section and is designed and configured to receive a substantially rectangular member.

Sleeve 14 includes first and third opposing sides 30 and 32 and second and fourth opposing sides 31 and 33, respectively. Through-hole 20 in sleeve 14 extends between opposing ends 40 and 41. The through-hole 20 preferably has a substantially rectangular cross section and is designed and configured to receive a substantially rectangular member.

Sleeve 16 includes first and third opposing sides 34 and 36 and second and fourth opposing sides 35 and 37, respectively. Through-hole 22 in sleeve 16 extends between opposing ends 42 and 43. The through-hole 22 preferably has a substantially rectangular cross section and is designed and configured to receive a substantially rectangular member.

In a preferred embodiment, the through-holes 18, 20, and 22 are dimensioned to receive 2"×4" wooden members. However, in alternate embodiments, the through-holes 18, 20, and 22 may have cross sections dimensioned to receive other sized members, such as 2"×6", 2"×8", and 4"×4" wooden members or other substantially rectangular members. In further alternate embodiments the through-holes 18, 20, and 22 may have non-rectangular cross-sections, provided the cross-sections of the through-holes are suitable for a bracket for a support platform. For example, the through-holes 18, 20, and 22 may have cross-sections that are substantially square, circular, or triangular.

Preferably, two apertures 46 are located in the first sides 26, 30 and 34 of the sleeves 12, 14, and 16. Alternatively, one aperture 46 or more than two apertures 46 may be located in the first side. Further, the apertures 46 may be located on any one or more of the sides of the sleeves 12, 14, and 16. For example, in sleeve 12 apertures may be located in the first side 26 and/or third side 28. The apertures 46 may be used for retaining devices 64 for fixedly retaining members in the sleeves in a selected position. Such retaining devices 64 include, but are not limited to, screws, bolts, spring-loaded mechanisms, and other suitable retaining devices.

As shown in FIG. 1, in a preferred embodiment, the first sleeve 12 is configured in a first alignment position. For purposes of simplifying the discussion, the first alignment position will be referred to as a "horizontal alignment position."

The second sleeve 14 is preferably connected to first sleeve 12 substantially at an angle ranging from about 65 to about 90 degrees from the horizontal alignment position. In a most preferred embodiment, the second sleeve is connected substantially at a 75 degree angle from the horizontal alignment position. At the intersection between the third side 32 and the first end 40, the second sleeve 14 is connected to the first sleeve's 12 intersection of the first side 26 and the second side 27 substantially adjacent the first end 38 of the first sleeve 12.

The third sleeve 16 is preferably connected to the first sleeve 12 substantially at an angle ranging from about 45 to about 65 degrees from the horizontal alignment position. In a most preferred embodiment, the third sleeve is substantially at a 57 degree angle from the horizontal alignment position. At the intersection between the third side 36 and the first end 42, the third sleeve 16 is connected to the first sleeve's 12 intersection of the first side 26 and the fourth side 29 at a location between the first end 38 and second end 39 of the first sleeve 12.

In further alternate embodiments, the second and third sleeves 14 and 16 may be attached to the brackets 10 at a variety of different locations and at different angles that may be suitable for a bracket for a support platform. For example, the second sleeve 14 and third sleeve 16 of the brackets 10 may be attached adjacent either end or between the ends 38 and 39 of the first sleeve 12.

Figure 2A:
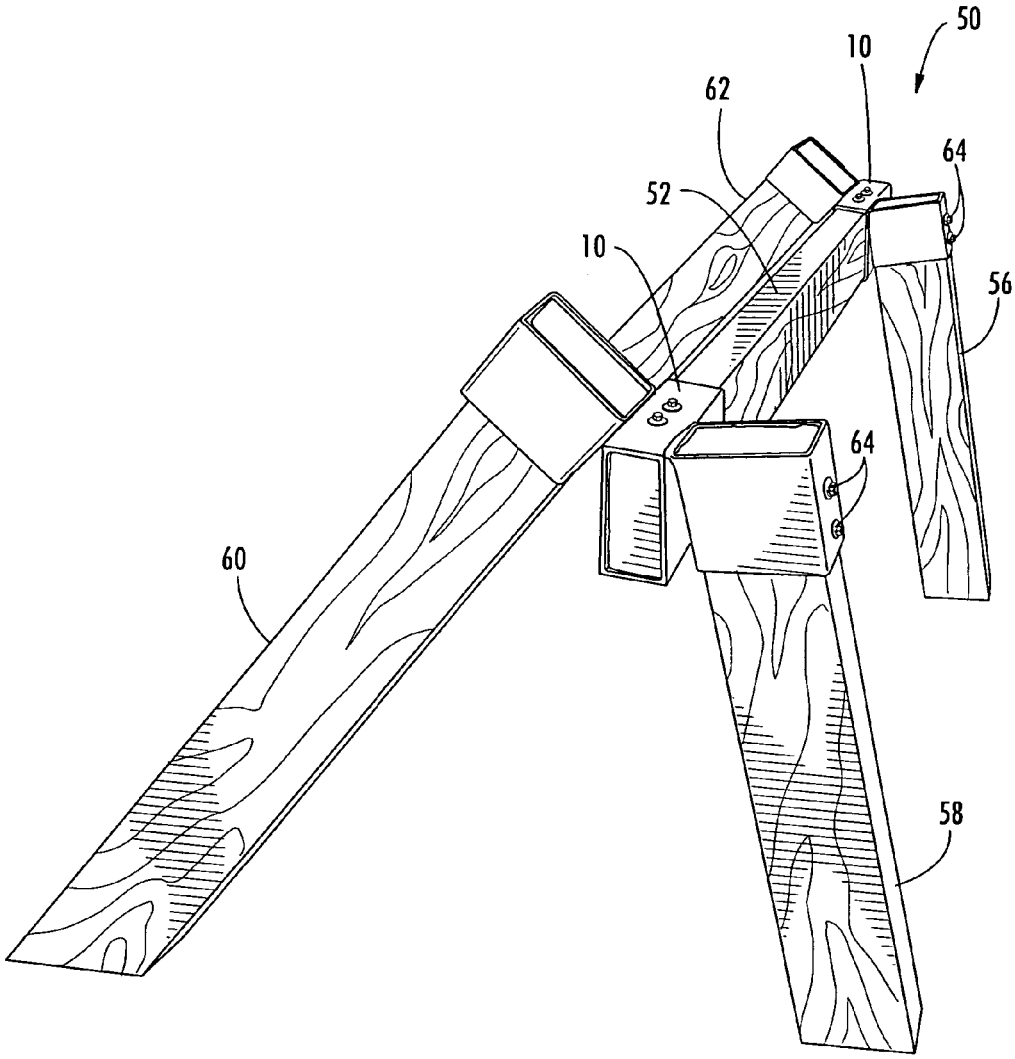
FIG. 2*a* is a perspective view of a support platform according to a preferred embodiment of the invention.
Figure 2B:
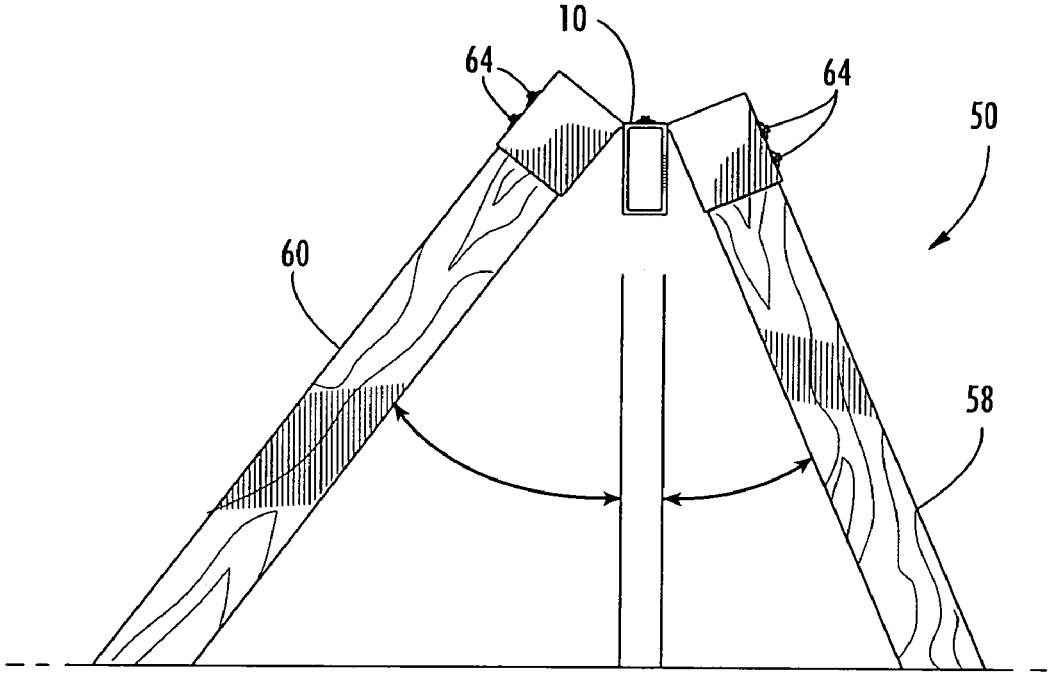
FIG. 2*b* is a side view of a support platform according to a preferred embodiment of the invention.

Referring now to FIGS. 2*a–b*, there is shown a support platform 50 according to a preferred embodiment of the invention. The support platform 50 includes a pair of support brackets 10. A cross member 52 is positioned so that the ends of the cross member 52 are slidably positioned within the through holes 18 of the first sleeves 12 of the support brackets 10. Leg members 56 and 58 are slidably positioned in the second sleeves 14 of the support brackets 10. Leg members 60 and 62 are slidably positioned in the third sleeves 16 of the support brackets 10. The cross member 52 and leg members 56–62 are preferably secured within the sleeves of the support brackets using retaining devices 64 located at the apertures 46.

In a typical use, a pair of support platforms 50 are used together. For example, support platforms are often used to saw wooden boards. The wood boards are laid on the cross members 52 of the support platforms, allowing a user a clear area between the support platforms to make the required cuts. Also, support panels may be laid across the cross members 52 for users to stand on for applications at an elevated level.

Figure 3:
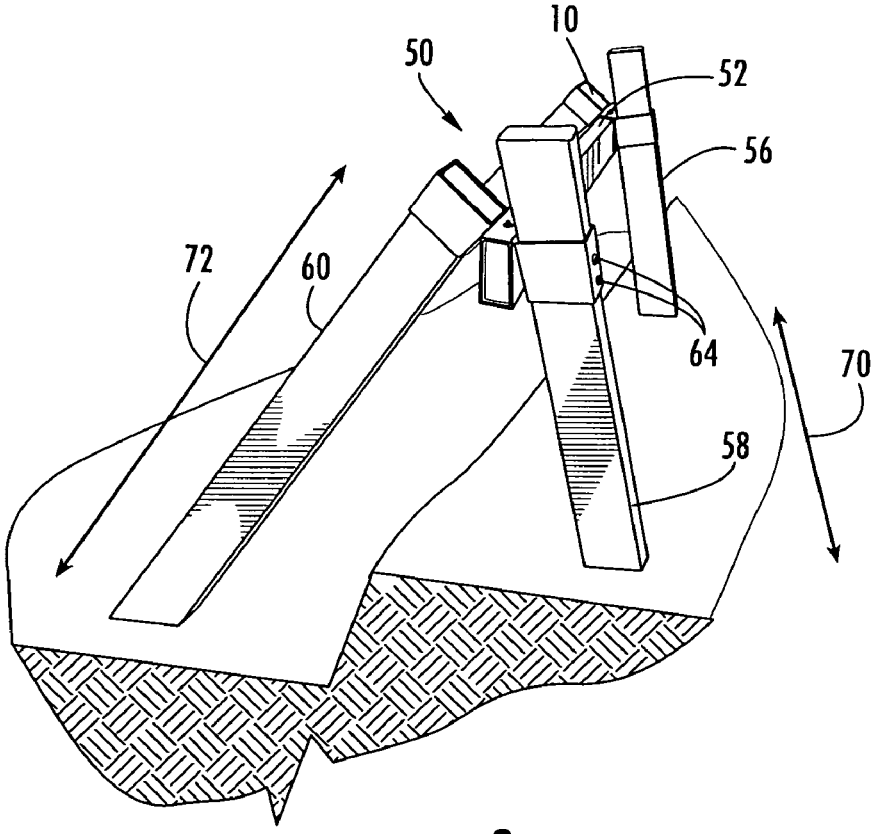
FIG. 3 is a perspective view of a support platform on an uneven surface according to a preferred embodiment of the invention.

The height of the support platform 50 is easily and readily adjustable, as shown in FIG. 3. When the support platform 50 is used on uneven terrain, the retaining devices 64 may be quickly removed from the leg members 56–62. The leg members may then be slid in the through-holes 20 and 22 of the second sleeves 14 and third sleeves 16 in the direction of arrows 70 and 72 to the correct height. The retaining devices 64 may then be reinserted into the leg members 56–62 to secure the support platform 50 at the correct height. This allows for the support bracket 50 to be easily used in a variety of situations, including on stairs, hills, and other uneven terrain. Further, the leg members do not have to be replaced when a different length leg is needed for the support platform.

The support platform 50 may be used in close proximity to obstacles, such as a wall, due to the leg members 56 and 58 extending no less than about a 65 to 80 degree angle from the horizontal. For example, a support platform may be used by a painter as a platform to stand on when painting a wall. Traditional support platforms have both leg members angled at 45 degrees with respect to the horizontal. Due to the interference caused by the outwardly extending legs, the traditional platforms cannot be located in close proximity to the wall to allow a painter to properly reach the wall. However, the support platform of the present invention allows the painter to stand substantially closer to a wall, since the legs extend at a relatively acute angle compared to the traditional support platform and place the cross member of the support platform closer to the wall.

Figure 4A:
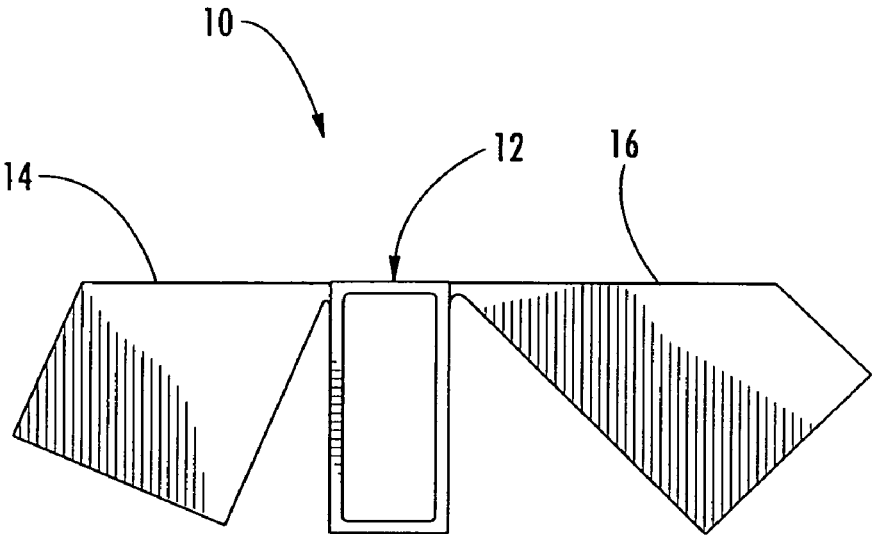
FIG. 4*a* is a side view of a support bracket according to a first alternate emdodiment of the invention.
Figure 4B:
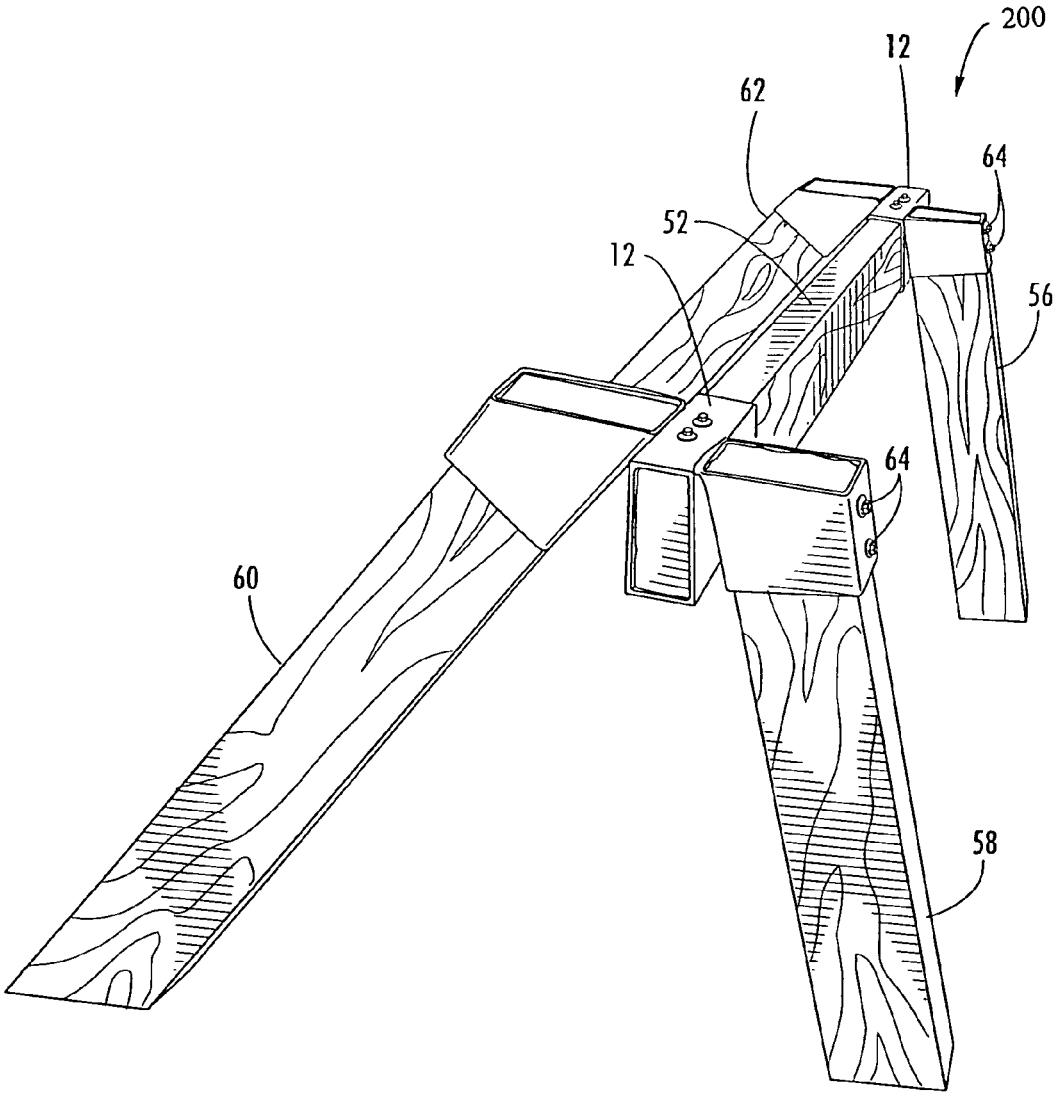
FIG. 4*b* is a perspective view of a support platform according to a first alternate embodiment of the invention.

Referring to FIGS. 4*a*, there is shown a first alternate embodiment of a support bracket 10, wherein the second and third sleeves 14 and 16 have an upper portion removed. A support platform 200 using these support brackets is shown in FIG. 4*b*. The support platform 200 provides a flat surface for use in construction. For example, a large wooden panel may be placed across the top of the entire support platform 200 without interference from any portion of the second and third sleeves 14 and 16.

Figure 5A:
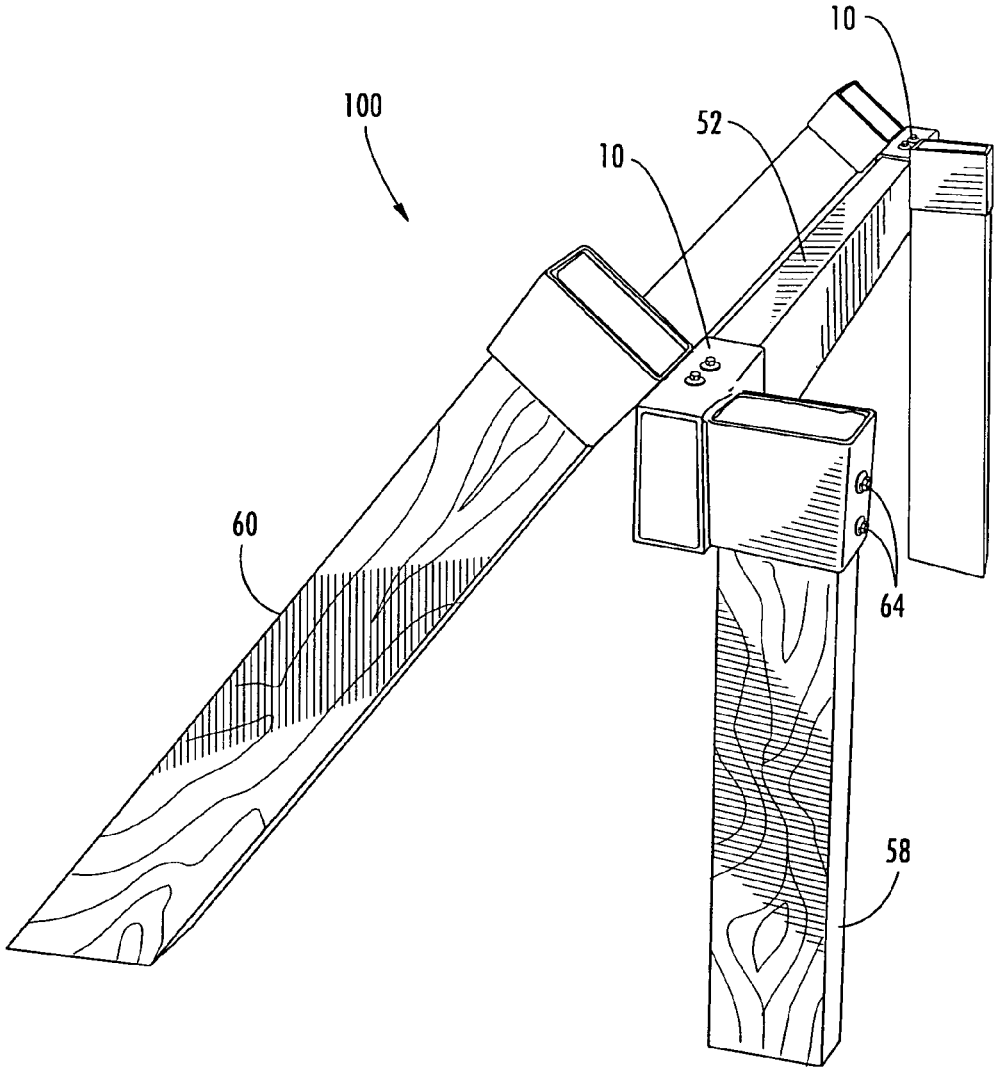
FIG. 5*a* is a perspective view of a support platform according to a second alternate embodiment of the invention.
Figure 5B:
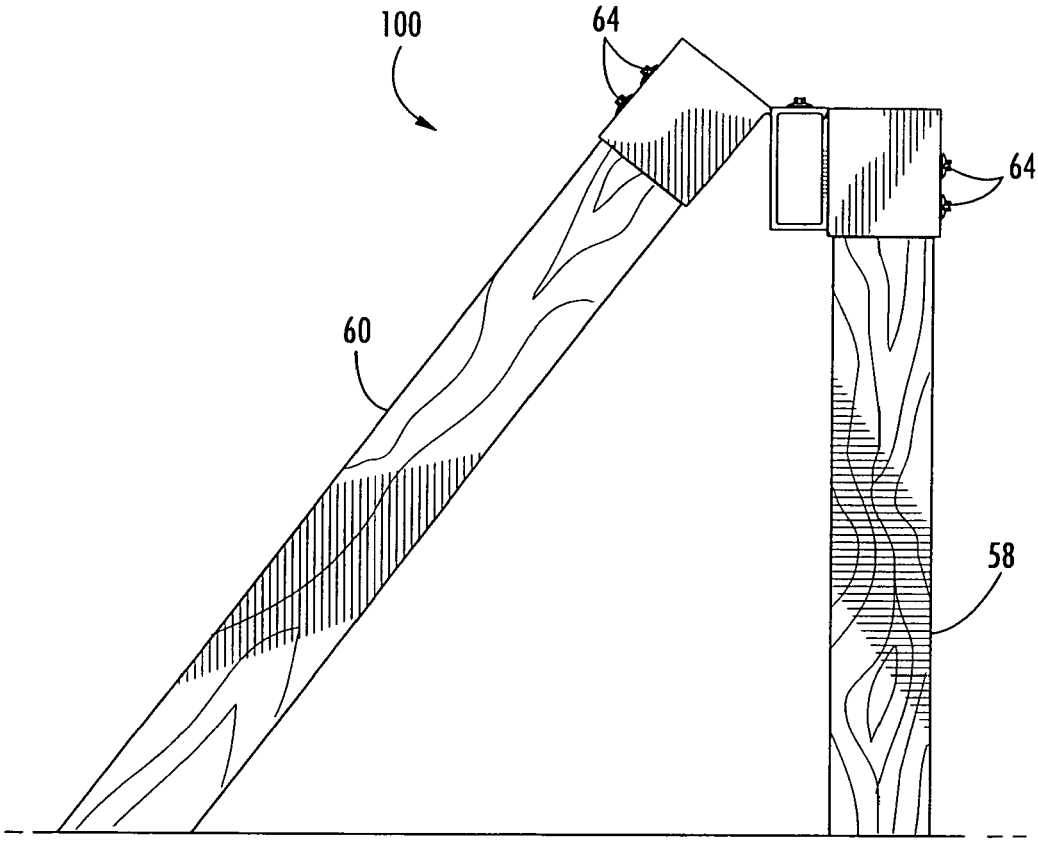
FIG. 5*b* is a side view of a support platform according to a second alternate embodiment of the invention.
Figure 6A:
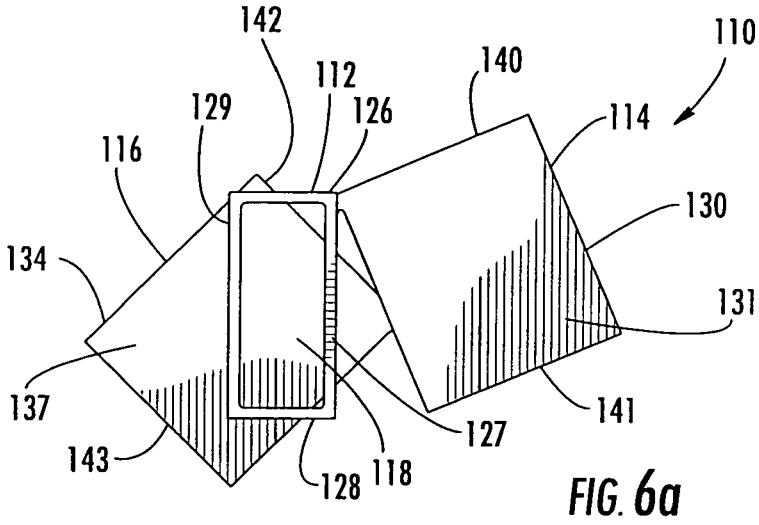
FIGS. 6*a–d* are side views of a support bracket according to a third alternate embodiment of the invention.
Figure 6B:
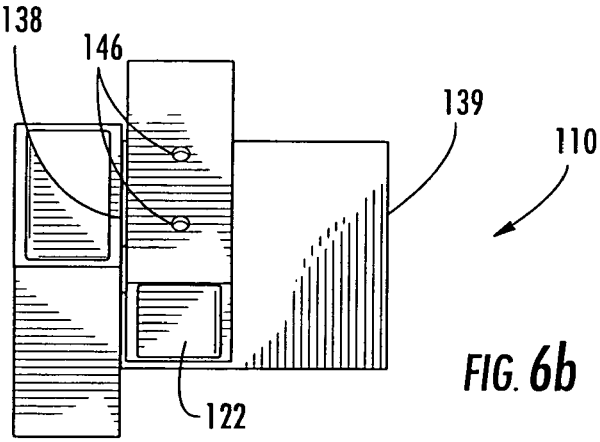
Figure 6C:
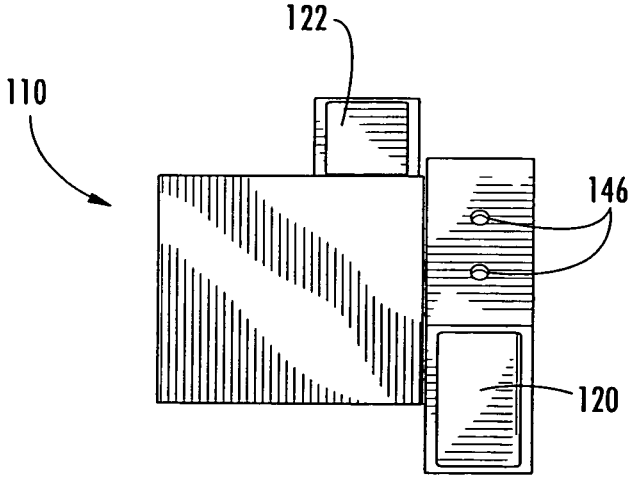
Figure 6D:
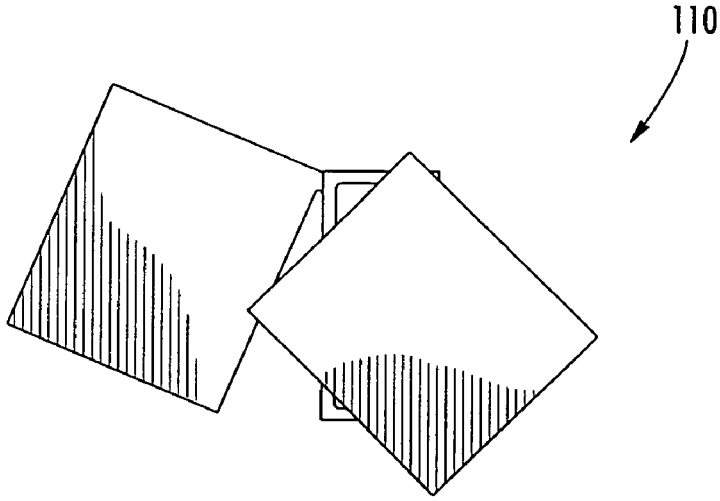
Figure 7A:
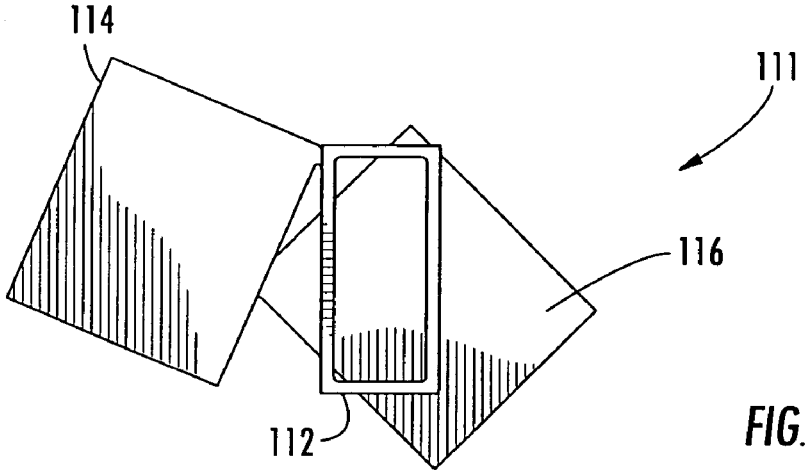
FIGS. 7*a–d* are side views of a second support bracket according to a third alternate embodiment of the invention.
Figure 7B:
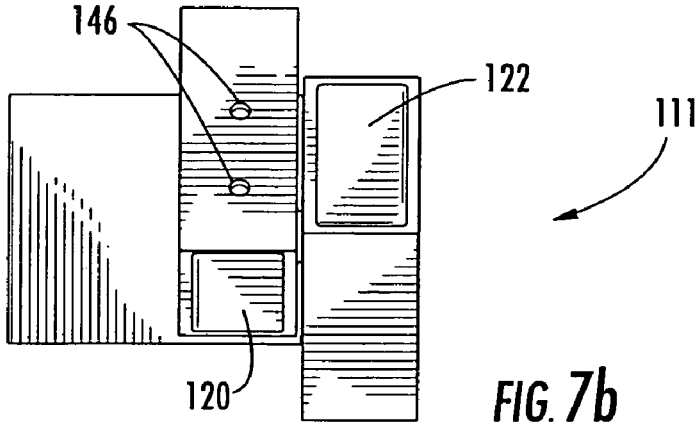
Figure 7C:
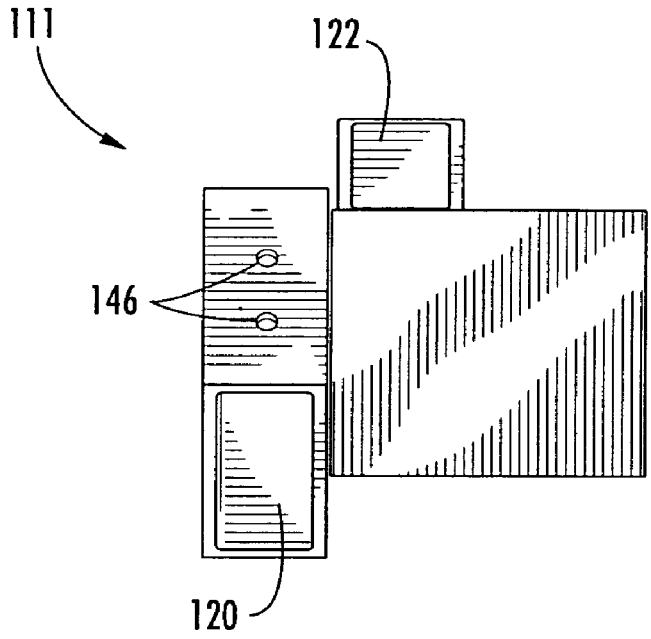
Figure 7D:
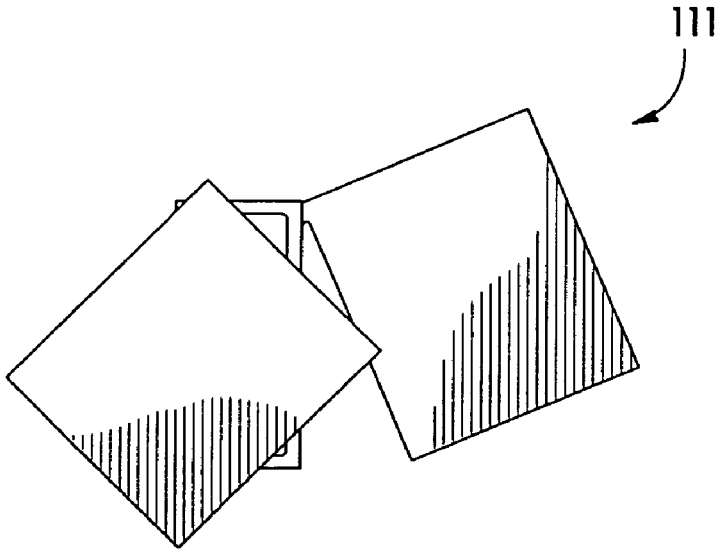

Referring now to FIGS. 5*a–b*, there is shown a second alternate embodiment of a support platform 100 of the present invention, wherein the second sleeves 14 of the support brackets 10 are in an alignment substantially perpendicular to the horizontal alignment. This support platform configuration may be placed against walls and other obstacles, offering improved proximity to the obstacle and safety. For example, in applications such as painting and wall-papering, a user may safely work at elevated levels next to a wall without causing an imbalance in the work platform, since the cross member is located substantially against the wall.

Other embodiments of the invention are also contemplated where the leg members may be located at any desired angle from vertical.

Figure 8:
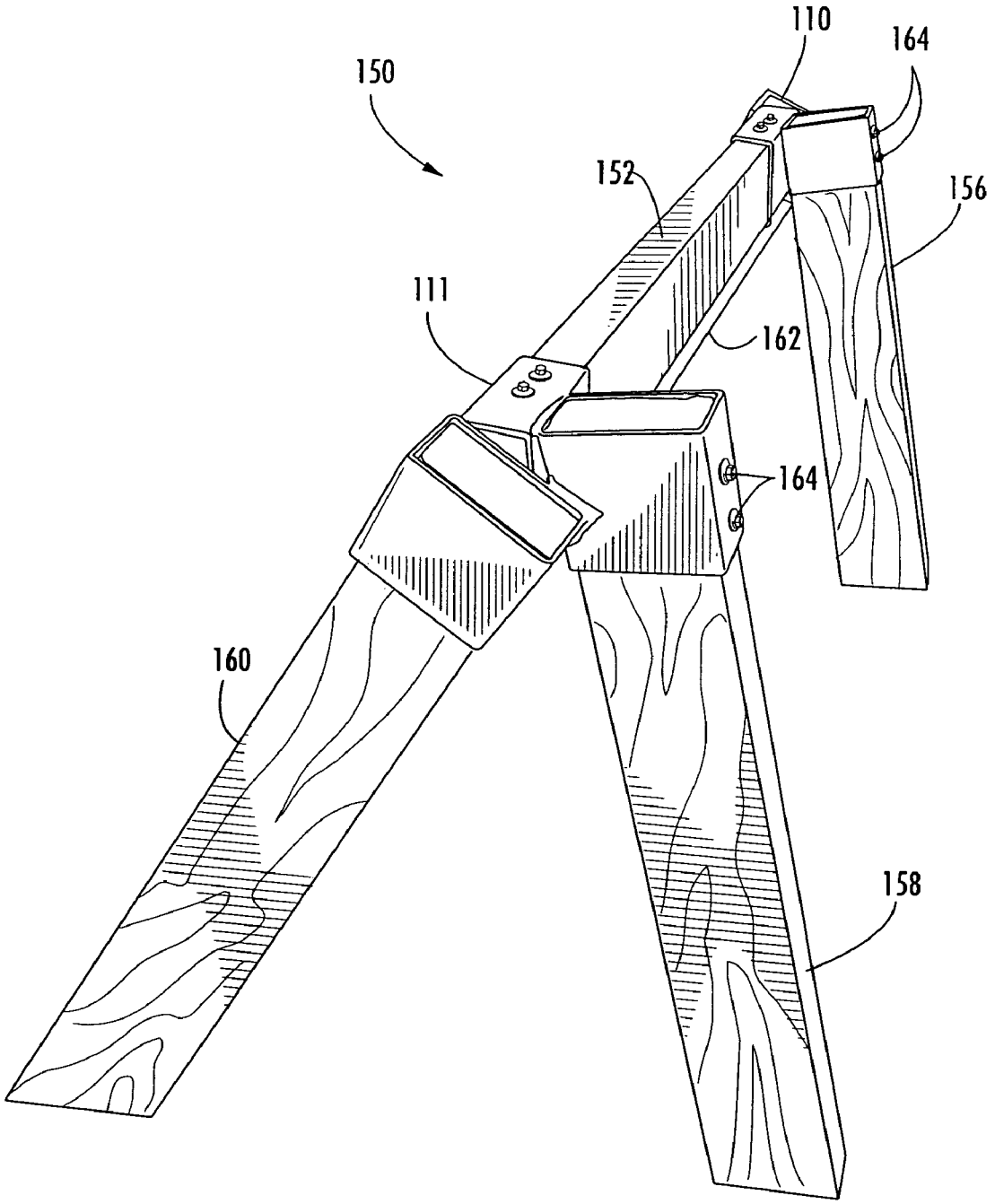
FIG. 8 is a perspective view of a support platform according to a third alternate embodiment of the invention.

A third alternate embodiment of the invention is shown in FIGS. 6–8, wherein differently configured brackets 110 and 111 are used in the support platform 150. Bracket 110 is shown in FIGS. 6*a–d*, wherein the first sleeve 112 is configured in a horizontal alignment position.

The second sleeve 114 is preferably connected to first sleeve 112 substantially at an angle ranging from about 65 to about 90 degrees from the horizontal alignment position. In a most preferred embodiment, the second sleeve is connected substantially at a 75 degree angle from the horizontal alignment position. At the intersection between the third side 132 and the first end 140, the second sleeve 114 is connected to the first sleeve's 112 intersection of the first side 126 and the second side 127 substantially adjacent the first end 138 of the first sleeve 112.

The third sleeve 116 is preferably connected to the first sleeve 112 and the second sleeve 114 substantially at an angle ranging from about 45 to about 70 degrees from the horizontal alignment position. In a most preferred embodiment, the third sleeve is substantially at a 57 degree angle from the horizontal alignment position. The fourth side 137 of the third sleeve 116 is connected to the first end 138 of the first sleeve 112. The fourth side 137 of the third sleeve is also preferably connected to the fourth side 133 of the second sleeve 114.

As shown in FIGS. 7*a–d*, an opposing support bracket 111 is configured substantially as a mirror image of support bracket 110. Unlike the support bracket 110 described above, in the opposing support bracket 111, the second sleeve 114 is connected to the first sleeve 112 substantially adjacent the second end 139 of the first sleeve 112. Also, the second side 135 of the third sleeve 116 is connected to the first sleeve 112 at the second end 139, and the second side 135 of the third sleeve 116 is preferably connected to the second side 131 of the second sleeve 114.

Referring now to FIG. 8, there is shown a support platform 150 according to a preferred embodiment of the invention. The support platform 150 includes a pair of opposing support brackets 110 and 111 as described above. A cross member 152 is positioned so that the ends of the cross member 152 are positioned within the through holes 118 of the support sleeves 110 and 111. Leg members 156 and 158 are slidably positioned in the second sleeves 114 of the support brackets 110 and 111. Leg members 160 and 162 are slidably positioned in the third sleeves 116 of the support bracket 110 and 111. The cross member 152 and leg members 156–162 are preferably secured within the sleeves of the support brackets using retaining devices 164 located at the apertures 146.

The foregoing description of preferred embodiments for this invention has been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. An adjustable height support platform comprising;

a first bracket and a second bracket, each bracket consisting of nonadjustably connected first, second and third sleeves;

a cross member extending between the brackets and inserted into the first sleeve of each of the brackets;

first leg members slidably inserted in and extending from the second sleeves of the brackets, wherein the first leg members extend from the second sleeves substantially away from a first side of the cross member at a first fixed angle;

second leg members slidably inserted in and extending from the third sleeves of the brackets, wherein the second leg members extend from the third sleeves substantially away from a second side of the cross member at a second fixed angle, wherein the second angle is less than the first angle.

2. The support platform of claim 1, wherein the first angle and the second angle are each more than about a 45 degree angle from a horizontal alignment position.

3. The support platform of claim 1, wherein the first leg members extend substantially at an angle ranging from about 45 to about 65 degrees from a horizontal alignment position.

4. The support platform of claim 1, wherein the second leg members extend substantially at an angle ranging from about 65 to about 90 degrees from a horizontal alignment position.

5. The support platform of claim 1, wherein the second leg members extend substantially perpendicular to a horizontal alignment position.

6. The support platform of claim 1, wherein the sleeves have a substantially rectangular cross-section.

7. The support platform of claim 1, wherein the cross member and first and second leg members have a substantially rectangular cross section.

8. The support platform of claim 1, wherein the first, second, and third sleeves of the first bracket and the first, second, and third sleeves of the second bracket each comprise welded steel sleeves.

9. The support platform of claim 1, wherein the first, second, and third sleeves of the first bracket and the first second, and third sleeves of the second bracket each comprise plastic sleeves.

10. The support platform of claim 1, wherein the sleeves comprise at least one aperture therein.

11. The support platform of claim 10, wherein the cross member and first and second leg members are retained within the sleeves by retaining devices which are located in the at least one apertures.

12. The support platform of claim 11, wherein the retaining devices are spring loaded mechanisms.

13. The support platform of claim 11, wherein the retaining devices are screws.

14. An adjustable height support platform comprising;

a first bracket and a second bracket, each bracket consisting of first, second and third sleeves having substantially rectangular cross-sections;

a cross member having a substantially rectangular cross-section and extending between the brackets and inserted into the first sleeve of each of the brackets;

first leg members having a substantially rectangular cross-section inserted in and extending from the second sleeves of the brackets, wherein the first leg members extend from the second sleeves substantially away from a first side of the cross member at an angle ranging from about 70 to about 90 degrees from a horizontal alignment position; and second leg members having a substantially rectangular cross section inserted in and extending from the third sleeves of the brackets, wherein the second leg members extend from the third sleeves substantially away from a second side of the cross member at an angle ranging from about 45 to about 65 degrees from the horizontal alignment position, and further wherein the second leg members are devoid of a linkage connecting the second leg members to the first leg members.

15. The support platform of claim 14, wherein the first, second, and third sleeves of the first bracket and the first, second, and third sleeves of the second bracket each comprise welded steel sleeves.

16. The support platform of claim 14, wherein the sleeves comprise at least one aperture therein.

17. The support platform of claim 16, wherein the cross member and first and second leg members are retained within the sleeves by retaining devices which are located in the at least one apertures.

18. An adjustable height support platform comprising;

a first bracket and a second bracket, each bracket consisting of first, second and third retaining assemblies;

a cross member extending between the brackets and releasably retained in the first retaining assembly of each of the brackets;

first leg members releasably retained by and extending from the second retaining assemblies of the brackets, wherein the first leg members extend from the second retaining assemblies substantially away from a first side of the cross member at an angle ranging from about 70 to about 90 degrees from a horizontal alignment position; and second leg members releasably retained by and extending from the third retaining assemblies of the brackets, wherein the second leg members extend from the third retaining assemblies substantially away from a second side of the cross member at an angle ranging from about 45 to about 65 degrees from the horizontal alignment position, and further wherein the second leg members are devoid of a linkage connecting the second leg members to the first leg members.

19. The support platform of claim 18, wherein the retaining assemblies are sleeves.

* * * * *